US008491089B2

(12) United States Patent
Nakazawa

(10) Patent No.: US 8,491,089 B2
(45) Date of Patent: Jul. 23, 2013

(54) LIQUID-DROPLET JETTING APPARATUS

(75) Inventor: Fumio Nakazawa, Okazaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/071,829

(22) Filed: Mar. 25, 2011

(65) Prior Publication Data

US 2011/0242207 A1 Oct. 6, 2011

(30) Foreign Application Priority Data

Mar. 30, 2010 (JP) ..... 2010-076644

(51) Int. Cl.
*B41J 2/165* (2006.01)

(52) U.S. Cl.
USPC ..... 347/30; 347/32; 347/29; 347/33

(58) Field of Classification Search
USPC ..... 347/30, 32, 29, 33
See application file for complete search history.

(56) References Cited

U.S. PATENT DOCUMENTS

| | | | | |
|---|---|---|---|---|
| 5,386,222 | A | 1/1995 | Iwata | |
| 5,570,116 | A * | 10/1996 | Soga | 347/30 |
| 6,154,231 | A | 11/2000 | Iwata | |
| 7,458,666 | B2 * | 12/2008 | Momose | 347/85 |
| 2006/0050105 | A1 | 3/2006 | Sakurai | |
| 2006/0214981 | A1 * | 9/2006 | Fukasawa et al. | 347/29 |
| 2008/0055357 | A1 * | 3/2008 | Hamasaki et al. | 347/30 |
| 2008/0088666 | A1 | 4/2008 | Shindo et al. | |
| 2009/0085956 | A1 * | 4/2009 | Shindo et al. | 347/19 |

FOREIGN PATENT DOCUMENTS

| | | |
|---|---|---|
| JP | H4-128051 | 4/1992 |
| JP | 6270419 | 9/1994 |
| JP | H6-344548 | 12/1994 |
| JP | 8267786 | 10/1996 |
| JP | H9-174881 | 7/1997 |
| JP | H9-262991 | 10/1997 |
| JP | 2004-268536 | 9/2004 |
| JP | 2006-076140 | 3/2006 |
| JP | 2007-105599 | 4/2007 |
| JP | 2007-136858 | 6/2007 |
| JP | 20080940040 | 4/2008 |
| JP | 2008/238431 | 10/2008 |
| JP | 2009-083167 | 4/2009 |
| JP | 2010-000780 | 1/2010 |

OTHER PUBLICATIONS

Notice of Reasons for Rejection of Japanese Patent Application No. 2010-076644 dated Jul. 24, 2012.

* cited by examiner

*Primary Examiner* — Matthew Luu
*Assistant Examiner* — Henok Legesse
(74) *Attorney, Agent, or Firm* — Frommer Lawrence & Haug LLP

(57) ABSTRACT

A liquid-droplet jetting apparatus which jets a liquid droplet of a liquid, includes: a liquid-droplet jetting head which has a nozzle for jetting the liquid droplet of the liquid; a maintenance mechanism which includes: a suction cap which comes into contact with and separates from the liquid-droplet jetting head and which faces the nozzle; a suction pump which sucks a fluid in a space defined by the suction cap and the liquid-droplet jetting head in a state that the suction cap comes into contact with the liquid-droplet jetting head; and a discharge tube which is connected to the suction pump and discharges the fluid flowing through the suction pump; and a maintenance controller which controls the maintenance mechanism.

10 Claims, 6 Drawing Sheets

LIQUID-DROPLET JETTING APPARATUS

CROSS REFERENCE TO RELATED APPLICATION

The present application claims priority from Japanese Patent Application No. 2010-076644, filed on Mar. 30, 2010, the disclosure of which is incorporated herein by reference in its entirety.

BACKGROUND OF THE INVENTION

1. Field of the Invention

The present invention relates to a liquid-droplet jetting apparatus which jets a liquid droplet from a nozzle.

2. Description of the Related Art

In an ink-jet printer described in US Published Patent Application No. 2008/0088666 (corresponding to Japanese Patent Application Laid-open No. 2008-94040), a suction cap, which comes into contact with/separates from an ink-jet head and which faces nozzles of the ink-jet head, and a suction pump which is connected to the suction cap are provided. Then, the suction pump is driven so that a space, which is defined by the suction cap and the ink-jet head when the suction cap is in contact with the ink-jet head, is reduced in pressure, and thereby discharging thickened inks and air bubbles in the ink-jet head from the nozzles. The sucked inks and air bubbles are discharged into a waste liquid tank connected to the suction pump through a tube.

Here, when the suction pump is driven in the state that the suction cap is in contact with the ink-jet head, and the thickened inks and air in the ink-jet head are discharged in the above-described manner, the ink with a high viscosity does not easily flow through the tube. Thus, there is sometimes a case that the ink with a high viscosity does not flow into the waste liquid tank from the suction cap via the suction pump. Particularly, the ink easily remains in the tube which connects the suction pump and the waste liquid tank and which is positioned on a downstream side with respect to the suction pump. Then, the viscosity of the ink remained in the tube increases as a standing time during which no discharging operation is performed goes by. Thus, when the similar operation is next performed in order to discharge the thickened inks and air in the ink-jet head, there is sometimes a case that the thickened ink remained in the tube does not flow by a suction speed of the suction pump. As a result, there is a risk that an internal pressure in the above-described tube increases to cause the tube to be pulled out of the suction pump.

SUMMARY OF THE INVENTION

An object of the present invention is to provide a liquid-droplet jetting apparatus capable of discharging a liquid and the like from a liquid-droplet jetting head while suppressing an increase in internal pressure of a tube through which the liquid is discharged.

According to an aspect of the present invention, there is provided a liquid-droplet jetting apparatus which jets a liquid droplet of a liquid, including: a liquid-droplet jetting head which has a nozzle for jetting the liquid droplet of the liquid; a maintenance mechanism which includes: a suction cap which comes into contact with and separates from the liquid-droplet jetting head and which faces the nozzle; a suction pump which sucks a fluid in a space defined by the suction cap and the liquid-droplet jetting head in a state that the suction cap comes into contact with the liquid-droplet jetting head; and a discharge tube which is connected to the suction pump and discharges the fluid flowing through the suction pump; and a maintenance controller which controls the maintenance mechanism, wherein the maintenance controller controls the suction cap to seal the space and controls the suction pump to perform a suction purge in which the liquid is sucked from the nozzle, the maintenance controller controls the suction pump to perform a discharging operation in which the fluid in the discharge tube is discharged before the suction purge, and the maintenance controller controls the suction pump so that power of the suction pump in the discharging operation is smaller than power of the suction pump in the suction purge.

When the suction purge is performed in a state in which the thickened liquid remains in the discharge tube connected to the suction pump, the liquid does not easily flow through the discharge tube, and as a result, there is a risk that an internal pressure in the discharge tube increases to cause the tube to be pulled out of the suction pump.

However, in the present invention, after the discharging operation is performed to discharge the thickened liquid in the discharge tube, the suction purge is performed. Accordingly, it is possible to prevent an internal pressure in the discharge tube from increasing when the suction purge is performed.

DETAILED DESCRIPTION OF THE PREFERRED EMBODIMENTS

Hereinafter, a preferred embodiment of the present invention will be explained.

Figure 1:
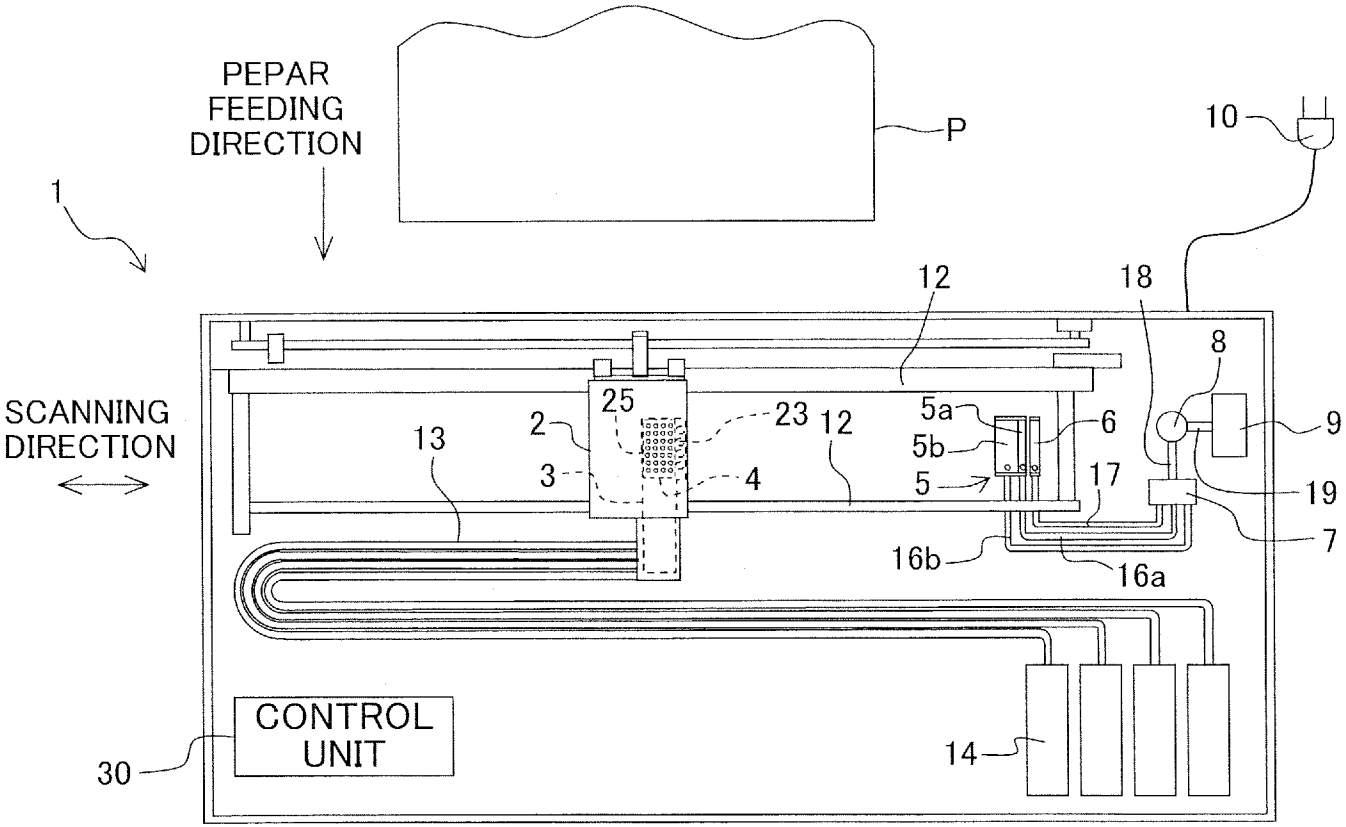
FIG. 1 is a schematic structure view of a printer according to an embodiment in the present invention.

As shown in FIG. 1, a printer 1 (liquid-droplet jetting apparatus) is provided with a carriage 2, a sub-tank 3, an ink-jet head 4, a suction cap 5, an exhaust cap 6, a switching device 7 (switching mechanism), a suction pump 8, a waste liquid tank 9, and so on. Further, the printer 1 has a plug 10 inserted in a socket to thereby have power supplied thereto externally, and can switch on/off of the power by a power supply switch 11 (see FIG. 3). Further, operations of the printer 1 are controlled by a control unit 30.

The carriage 2 reciprocates in a scanning direction along two guide rails 12 extending in parallel to each other in the scanning direction (right and left direction in FIG. 1). The sub-tank 3 is mounted on the carriage 2, and is connected to four ink cartridges 14 via four tubes 13. Then, four color inks of black, yellow, cyan, and magenta stored in the four ink cartridges 14 respectively are supplied to the sub-tank 3 through the four tubes 13.

The ink-jet head 4 (a liquid-droplet jetting head) is arranged on a lower surface of the sub-tank 3, and the above-described four color inks are supplied to the ink-jet head 4 from the sub-tank 3, and ink droplets of four colors are jetted from a plurality of nozzles 25 formed on a lower surface of the ink-jet head 4.

Then, in the printer 1, printing is performed on a recording paper P by jetting the ink droplets from the ink-jet head 4 which reciprocates in the scanning direction together with the carriage 2 onto the recording paper P which is transported in a paper feeding direction perpendicular to the scanning direction (downward in FIG. 1) by a not-illustrated paper transporting mechanism.

Figure 2:
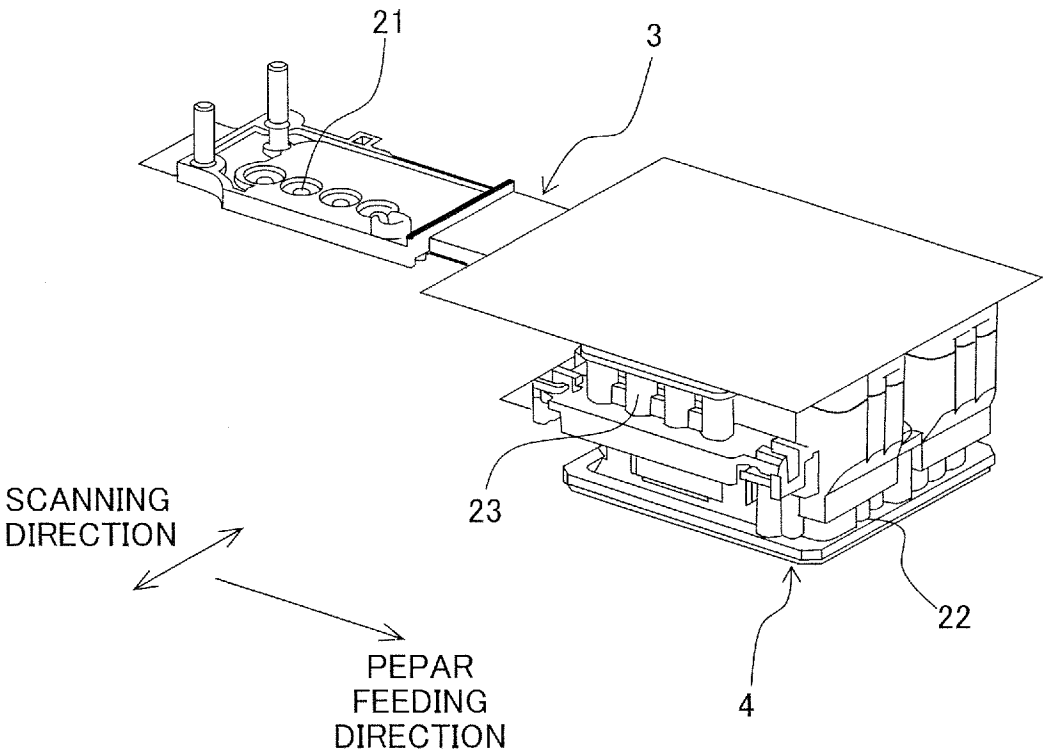
FIG. 2 is a perspective view showing an appearance of a sub-tank and an ink-jet head in FIG. 1.

Here, the sub-tank 3 and the ink-jet head 4 will be explained. As shown in FIG. 2, the sub-tank 3 is provided with four tube connection ports 21, four ink supply channels 22, four air discharge channels 23 and so on.

The four tube connection ports 21 are arranged at one end portion of the sub-tank 3 in the paper feeding direction (lower end portion in FIG. 1) and the above-described four tubes 13 are connected thereto. The four ink supply channels 22 are arranged at the other end portion of the sub-tank 3 in the paper feeding direction on a side opposite to the tube connection ports 21 (upper end portion in FIG. 2) and are connected to the tube connection ports 21 via ink channels with not-illustrated damper chambers for suppressing pressure fluctuations of the inks and the like. Further, the ink supply channels 22 each extend in an up and down direction (in FIG. 1, a direction vertical to the paper, a direction perpendicular to the paper feeding direction and the scanning direction), and lower ends thereof are connected to the ink-jet head 4 arranged on the lower surface of the sub-tank 3.

Here, the ink supply channels 22 each extend in the up and down direction, and thereby air mixed in the inks move upward in the ink supply channels 22 and are accumulated in upper end portions of the ink supply channels 22. Then, this makes it difficult for the air to flow into the ink-jet head 4 when the inks flow into the ink-jet head 4.

The four air discharge channels 23 are connected to the upper end portions of the ink supply channels 22, and by a later-described air discharging purge, the air accumulated in the upper end portions of the ink supply channels 22 are discharged to the outside from the air discharge channels 23.

Further, the ink-jet head 4 is provided with a channel unit and a piezoelectric actuator which are not illustrated. In the channel unit, manifold channels to which the inks are supplied from ink supply ports connected to the ink supply channels 22 and a plurality of individual ink channels which extend from outlet ports of the manifold channels to the nozzles 25 through pressure chambers are formed. The piezoelectric actuator applies pressures to the inks in the pressure chambers for jetting the ink droplets from the nozzles 25.

Further, in the ink-jet head 4, the nozzles 25, as shown in FIG. 1, are arranged in the paper feeding direction to form one nozzle row, and four of the nozzle row as above are arranged in the scanning direction. Then, the black, yellow, cyan, and magenta ink droplets are jetted from the nozzles 25 that form the four nozzle rows and are arranged in order from the right in FIG. 1.

Incidentally, the structures of the sub-tank 3 and the ink-jet head 4 themselves are similar to those of conventional ones, and are not directly related to a characteristic portion of the present invention. Therefore the further detailed explanations are omitted here.

The suction cap 5 is arranged at a position facing the ink-jet head 4 when the carriage 2 moves to the right substantially maximally in FIG. 1. The suction cap 5 is provided with a first cap portion 5*a* facing the nozzles 25 that form the nozzle row disposed on the rightmost side in the above state and jet the black ink droplets, and a second cap portion 5*b* covering the nozzles 25 that form the remaining three nozzle rows and jet the color (yellow, cyan, and magenta) ink droplets.

The suction cap 5 can move in the up and down direction (direction vertical to the paper in FIG. 1) by a cap moving mechanism 15 (see FIG. 3) (is designed to be able to come into contact with/separate from the ink-jet head 4). Then, when the suction cap 5 is moved upward (to a near side in the direction vertical to the paper in FIG. 1) until it comes into contact with the ink-jet head 4 in the state that the carriage 2 is positioned at the above-described position, spaces which face the nozzles 25 jetting the black ink droplets and the nozzles 25 jetting the color ink droplets are defined by the first cap portion 5*a*, the second cap portion 5*b*, and the ink-jet head 4, respectively. Further, the suction cap 5 is moved downward (to a far side in the direction vertical to the paper in FIG. 1), and thereby the suction cap 5 can be brought into a state in which the first cap portion 5*a* and the second cap portion 5*b* are separated from the ink-jet head 4, namely a state in which a suction pressure of the suction pump 8 does not act so as to suck the inks from the nozzles 25.

The exhaust cap 6 is arranged at a position facing the air discharge channels 23 of the sub-tank 3 when the carriage 2 moves to the right substantially maximally in FIG. 1. The exhaust cap 6 can move in the up and down direction (the direction vertical to the paper in FIG. 1) by the cap moving mechanism 15 (see FIG. 3), and is moved upward (to the near side in the direction vertical to the paper in FIG. 1) in the state that the carriage 2 is positioned at the above-described position, thereby being connected to the air discharge channels 23. Further, the exhaust cap 6 is moved downward (to the far side in the direction vertical to the paper in FIG. 1) to be separated from the air discharge channels 23.

Further, the first cap portion 5*a* and the second cap portion 5*b* in the suction cap 5 and the exhaust cap 6 are connected to the switching device 7 via tubes 16*a*, 16*b*, and 17 respectively, and the switching device 7 is connected to the suction pump 8 via a tube 18. Then, the switching device 7 can switch to one of a state in which the suction pump 8 and the first cap portion 5*a* are connected, a state in which the suction pump 8 and the second cap portion 5*b* are connected, and a state in which the suction pump 8 and the exhaust cap 6 are connected.

The suction pump 8 is, for example, a tube pump or the like. Then, in the printer 1, as described above, the suction pump 8 is driven in a state in which the spaces facing the nozzles 25 are sealed by the first cap portion 5*a* and the second cap portion 5*b*, and the suction pump 8 and the first cap portion 5*a* and the second cap portion 5*b* are connected by the switching device 7. In this way, a suction purge in which inks, air, and so on (fluids) in the above-described spaces are sucked so that the black and color inks in the ink-jet head are discharged from the nozzles 25 respectively can be performed.

Further, as described above, the suction pump 8 is driven in a state in which the exhaust cap 6 is connected to the air discharge channels 23 and the suction pump 8 and the exhaust cap 6 are connected by the switching device 7. In this way, the air discharging purge in which air accumulated in the ink-jet head 4, the ink supply channels 22 of the sub-tank 3, and so on are sucked from the air discharge channels 23 can be performed.

Incidentally, the above-described air discharging purge is designed that a driving speed of the suction pump 8 is slowed as compared with that of the suction purge in order to prevent meniscuses of the nozzles 25 from being broken due to the suction of the air from the air discharge channels 23. Concretely, the ratio of a suction speed in the suction purge of the black ink to a suction speed in the air discharging purge is about 1:0.0555, and the ratio of a suction speed in the suction purge of the color inks to the suction speed in the air discharging purge is about 1:0.22.

Further, the suction pump 8 is connected to the waste liquid tank 9 via a discharge tube 19, and the inks and air that are sucked by the above-described suction purge are discharged into the waste liquid tank 9 from the discharge tube 19 through the suction cap 5, the tubes 16*a*, 16*b*, and 18, and the suction pump 8. On the other hand, the inks and air that are sucked by the air discharging purge are discharged into the waste liquid tank 9 from the discharge tube 19 via the exhaust cap 6, the tubes 17, 18, and the suction pump 8. Incidentally, by driving the suction pump 8 with a suction pressure such that the inks are not sucked from the nozzles 25 of the ink-jet head 4, the inks, which remain in the discharge tube 19 after the suction purge or the air discharging purge and which are thickened, are discharged into the waste liquid tank 9 from the discharge tube 19 by inks and air (fluid) which are sucked from the suction cap 5 or the exhaust cap 6 and discharged into the discharge tube 19 through the suction pump 8.

Incidentally, in this embodiment, the combination of the suction cap 5, the exhaust cap 6, the switching device 7, the suction pump 8, the waste liquid tank 9, and the tubes 16*a*, 16*b*, 17, 18, 19 through which the above are connected corresponds to a maintenance mechanism according to the present invention.

Figure 3:
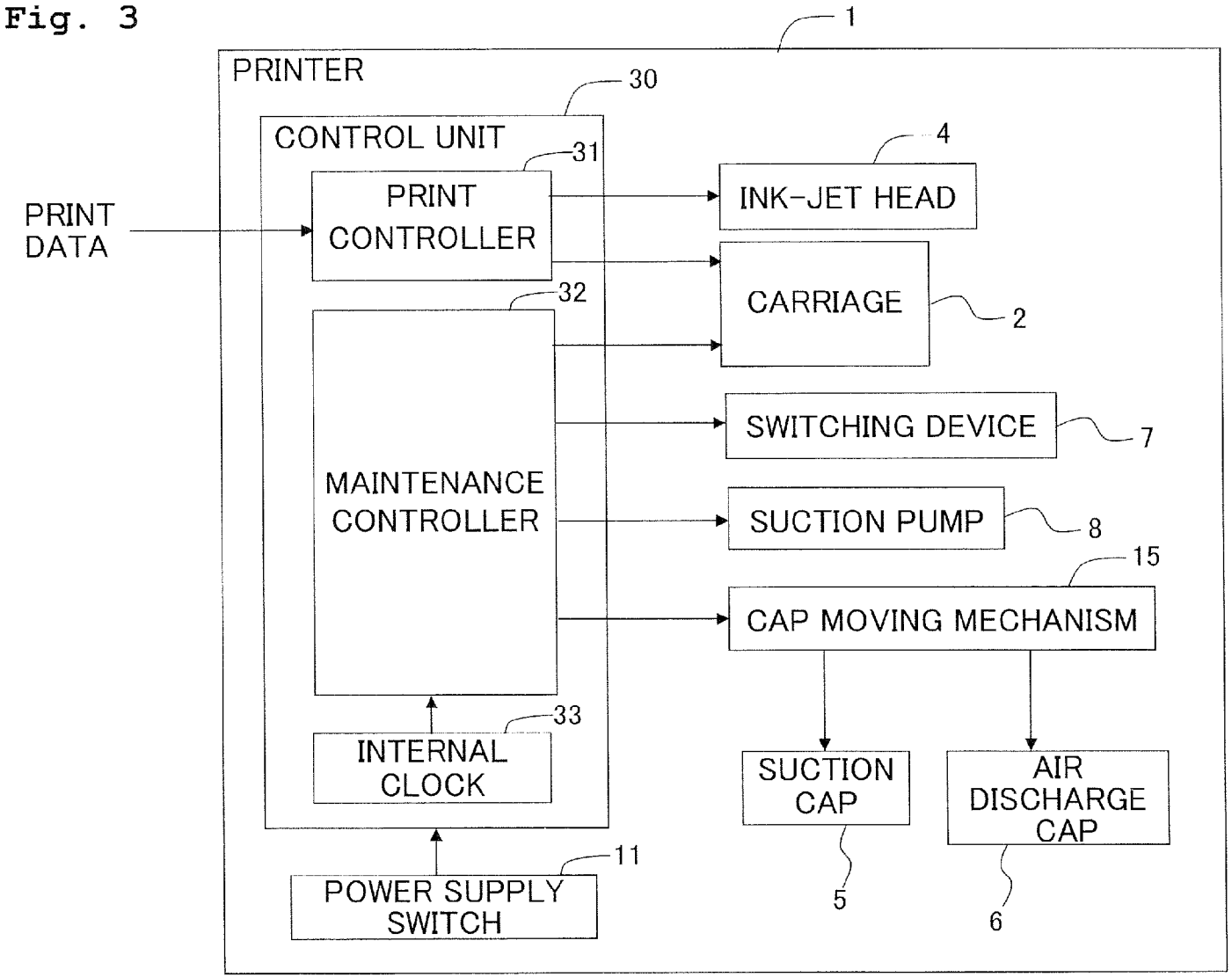
FIG. 3 is a functional block diagram of a control unit in FIG. 1.

Next, the control unit 30 which controls the printer 1 will be explained with reference to a functional block diagram in FIG. 3.

The control unit 30 is provided with a CPU (Central Processing Unit), a ROM (Read Only Memory), a RAM (Random Access Memory), and so on, and they operate as a print controller 31, a maintenance controller 32, and so on. Further, an internal clock 33 is installed in the control unit 30.

The print controller 31 controls the carriage 2, the ink-jet head 4, the not-illustrated paper transporting mechanism, and so on when performing printing in the printer 1. The maintenance controller 32 controls the carriage 2, the cap moving mechanism 15, the switching device 7, the suction pump 8, and so on when performing maintenance of the ink-jet head, such as the above-described suction purge and air discharging purge, and a later-described discharging operation.

The internal clock 33 is a clock to be driven by a battery, and performs measurement of a quiescent period during which no ink droplets are jetted from the ink-jet head 4, and the like. Further, when the internal clock 33 is left for a long period in a state where the plug 10 is pulled out, the battery runs out, and when the plug 10 is inserted in a socket thereafter, the internal clock 33 returns from battery exhaustion and, at this time, transmits a predetermined signal indicating that the above-described quiescent period is long (predetermined signal related to the quiescent period) to the maintenance controller 32.

Figure 4:
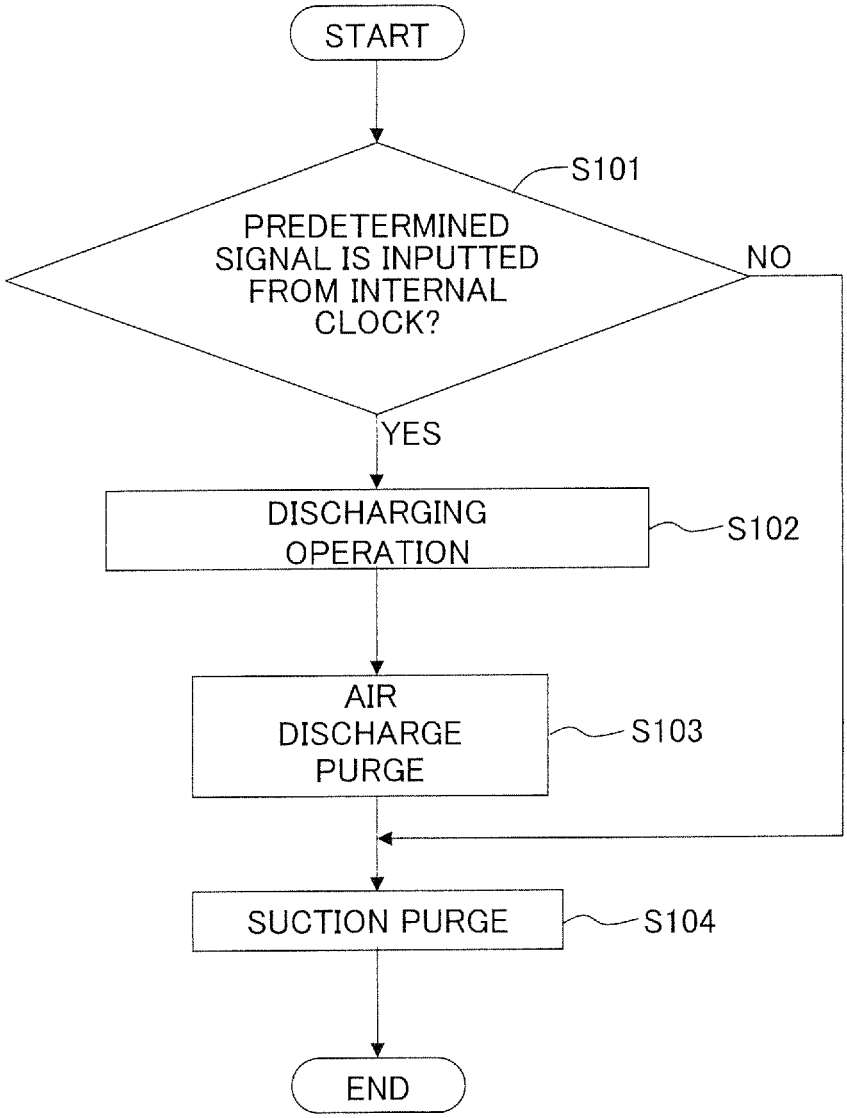
FIG. 4 is a flowchart showing a procedure of a maintenance operation to be performed in the printer.

Next, a maintenance operation including the suction purge, to be performed immediately after the power is turned on in the printer 1, will be explained with reference to FIG. 4.

When the power is turned on in the printer 1, the maintenance controller 32 evaluates presence or absence of input of the predetermined signal indicating that the quiescent period is long from the internal clock 33 (Step S101, which will be simply denoted as S101 and the like, hereinafter). When the predetermined signal from the internal clock 33 is inputted (S101: YES), the maintenance controller 32 first moves the suction cap 5 downward, thereby bringing the suction cap 5 into the state in which the first cap portion 5*a* and the second cap portion 5*b* do not come into contact with the ink-jet head 4. Further, the maintenance controller 32 moves the exhaust cap 6 downward so that the exhaust cap 6 is not connected to the air discharge channels 23. Then, the suction pump 8 is driven so that power (energy to do work) of the suction pump 8 is smaller than power of the suction pump 8 in the suction purge. For instance, the suction pump 8 is driven at a suction speed slower than the suction speed in the suction purge, for example, at a suction speed which is substantially equal to the suction speed in the air discharging purge (the discharging operation is performed) (Step S102).

Thereby, the inks that are accumulated in the discharge tube 19 and the like after the latest suction purge and are thickened because moisture of the inks evaporates as the time goes by, and the like are discharged into the waste liquid tank 9. Incidentally, at this time, the switching device 7 may connect the suction pump 8 either to the suction cap 5 or to the exhaust cap 6.

Then, the maintenance controller 32 controls the exhaust cap 6, the switching device 7, the suction pump 8, and so on to perform the air discharging purge (S103), and further controls the suction cap 5, the switching device 7, the suction pump 8, and so on to perform the suction purge (S104), and ends the maintenance operation. On the other hand, when the predetermined signal from the internal clock 33 is not inputted (S101: NO), namely when the period during which no ink droplets are jetted from the ink-jet head 4 is not long, it is thought that the degree of viscosity increase of the ink accumulated in the discharge tube 19 is low. Thus, the maintenance controller 32 does not perform the discharging operation (S102) and the air discharging purge (S103) but performs only the suction purge (S104), and ends the maintenance operation.

Here, when the power is turned on, it is often the case that the period during which no ink droplets are jetted from the ink-jet head 4 (quiescent period) is long and a large amount of the thickened ink is accumulated in the discharge tube 19. Thus, unlike this embodiment, when the discharging operation at S102 and the air discharging purge at S103 are not performed but the suction purge at S104 is performed immediately after the power is turned on, there arises a risk that the thickened ink in the discharge tube 19 does not flow through the discharge tube 19 in accordance with the suction speed of the suction pump 8 and an internal pressure in the discharge tube 19 is increased. Further, when the internal pressure in the discharge tube 19 increases, there arises a risk that the discharge tube 19 is pulled out of the suction pump 8.

Thus, in this embodiment, before the suction purge is performed at 5104, the discharging operation in which the suction pump 8 is driven at the suction speed slower than that in the suction purge is performed at S102 in the state that the suction cap 5 does not seal the spaces facing the nozzles 25, and thereby the thickened ink in the discharge tube 19 is discharged into the waste liquid tank 9. Here, the suction speed of the suction pump 8 in the discharging operation is slower than that of the suction pump 8 in the suction purge, so that the thickened ink in the discharge tube 19 flows through the discharge tube 19 in accordance with the suction speed of the suction pump 8. Accordingly, the internal pressure in the discharge tube 19 does not easily increase.

Since the suction purge is performed after the thickened ink in the discharge tube 19 is discharged by the discharging operation, it is possible to prevent the internal pressure in the discharge tube 19 from increasing when the suction purge is performed.

Further, the viscosity of the ink in the discharge tube 19 increases due to the evaporation of the moisture contained in the ink as the time goes by, as the quiescent period becomes longer, a greater amount of the thickened ink is accumulated in the discharge tube 19. In this case, there is sometimes a case that the discharging operation at S101 is not enough to discharge the ink in the discharge tube 19.

Further, if the quiescent period is long, there is often a case that a large amount of air is accumulated in the ink-jet head 4 or the sub-tank 3 communicating with the ink-jet head 4. Then, there is also a risk that a jet characteristic of the ink droplets from the ink-jet head 4 is changed by the above air.

On the other hand, the fact that the internal clock 33 in the control unit 30 runs out of battery means that the plug 10 is not inserted in a socket for a long period, namely that the quiescent period is long, and further, at the time when the plug 10 is inserted in a socket thereafter and the internal clock 33 returns from battery exhaustion, the quiescent period is further lengthened. Thus, at this time, a large amount of the thickened ink is often accumulated in the discharge tube 19.

Thus, in this embodiment, as described above, when returning from battery exhaustion, the internal clock 33 inputs the above-described predetermined signal to the maintenance controller 32. Then, when the above-described predetermined signal is inputted to the maintenance controller 32, the discharging operation is performed (S102) and then the air discharging purge is further performed (S103), and thereafter the suction purge is performed (S104).

In this case, the air discharging purge makes it possible not only to discharge the air in the ink-jet head 4 into the waste liquid tank 9 from the air discharge channels 23 through the suction pump 8, the discharge tube 19, and so on but also to discharge the thickened ink in the discharge tube 19 into the waste liquid tank 9.

Further, when the air discharging purge is performed, the inks are also discharged a little from the air discharge channels 23 together with the air. Accordingly, the thickened ink in the discharge tube 19 is mixed with the inks discharged from the air discharge channels 23 and the viscosity of the thickened ink in the discharge tube 19 is reduced. Thus, the ink in the discharge tube 19 becomes easily discharged.

Next, modification examples where various changes are made to this embodiment will be explained. However, as for those having the same structures as those of this embodiment, explanations thereof will be omitted when appropriate.

In the above-described embodiment, if the predetermined signal to be inputted when the internal clock 33 returns from battery exhaustion is inputted to the maintenance controller 32, the air discharging purge is performed subsequently to the discharging operation. However, the present invention is not limited to the above.

Figure 5:
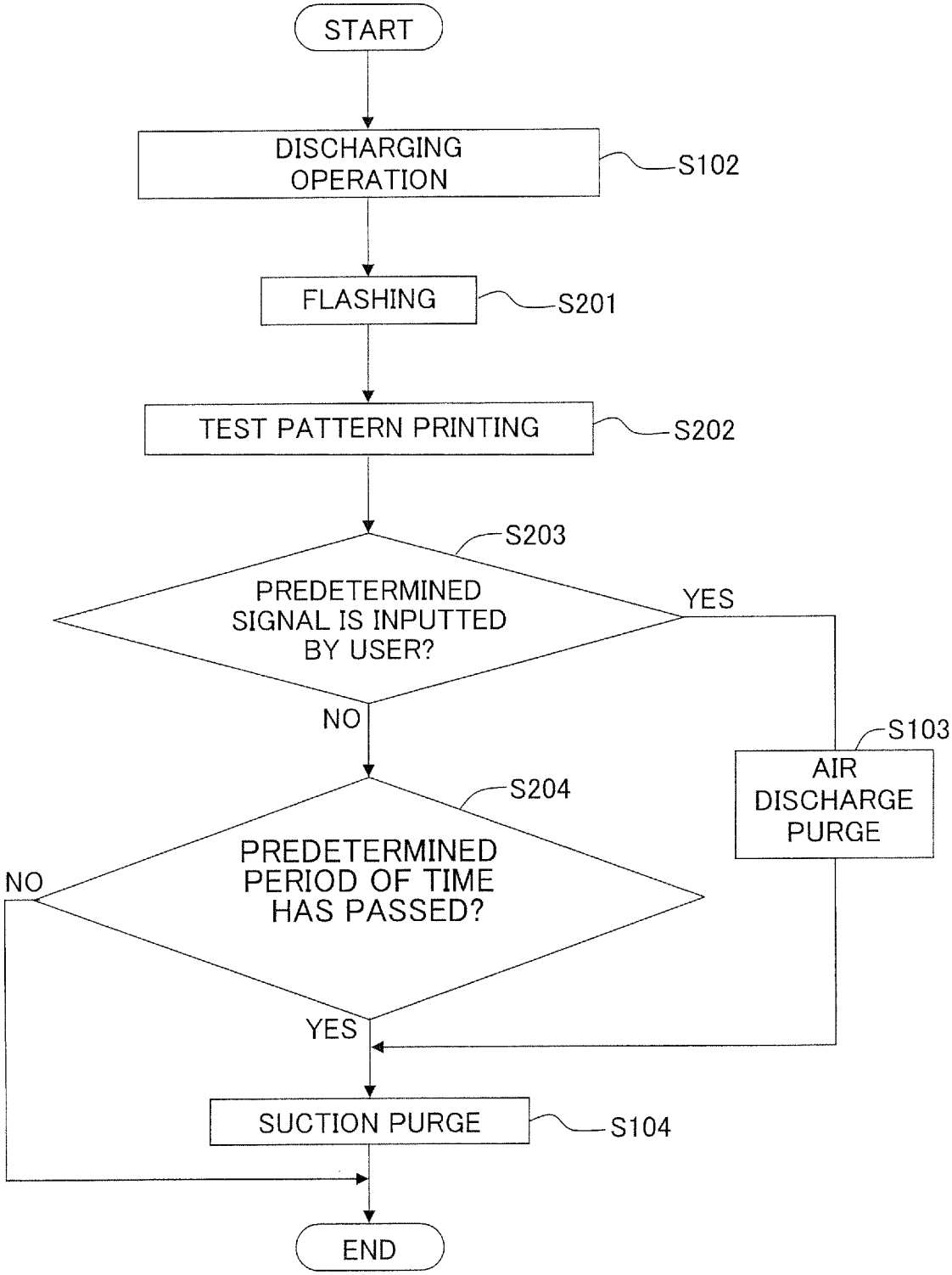
FIG. 5 is a flowchart corresponding to FIG. 4, of a modification example 1.

In one modification example (a modification example 1), as shown in FIG. 5, after the discharging operation at S102, the maintenance controller 32 makes the printer 1 perform what is called flashing in which the inks are jetted from the nozzles 15, thereby discharging the thickened inks in the nozzles 15 (S201), and makes the printer 1 print a test pattern for examining the number of the nozzles 25 from which no ink droplets are jetted (S202). Then, a user sees the printed test pattern to evaluate the length of the quiescent period by the number of the nozzles 25 from which no ink droplets are jetted. At this time, the user evaluates the quiescent period to be long in a case that, for example, the ratio of the nozzles 25 from which no ink droplets are jetted is more than a predetermined ratio.

Then, if the user evaluates that the quiescent period is long, the user operates input buttons 34 (input section) provided on the printer 1, a not-illustrated PC connected to the printer 1, or the like to input a predetermined signal indicating that the quiescent period is long to the maintenance controller 32. The maintenance controller 32 evaluates whether or not the above-described predetermined signal is inputted by the user (S203). If the above-described predetermined signal is inputted by the user (S203: YES), the maintenance controller 32, similarly to the above-described embodiment, further performs the air discharging purge (S103) and then performs the suction purge (S104), and ends the maintenance operation.

On the other hand, if the above-described predetermined signal is not inputted by the user (S203: NO), the maintenance controller 32 evaluates whether a predetermined period of time goes by after the latest maintenance operation (S204). If the predetermined period of time goes by (S204: YES), the maintenance controller 32 performs the suction purge (S104), and ends the maintenance operation. If the predetermined period of time does not go by (S204: NO), the maintenance controller 32 ends the maintenance operation without performing the suction purge.

In the above case, after the discharging operation and when the user evaluates that the air discharging purge is necessary to be performed, the air discharging purge is performed. Namely, the user can select whether or not the air discharging purge is to be performed.

Further, in the modification example 1, after the discharging operation, the test pattern is printed, and based on the printed test pattern, the user inputs the above-described predetermined signal indicating that the quiescent period is long. However, the present invention is not limited to the above. For example, it may also be designed that, before the discharging operation, the above-described test pattern is printed and the above-described predetermined signal is inputted. Then, if the above-described predetermined signal is inputted, after both the discharging operation and the air discharging purge are performed, the suction purge may also be performed. If the above-described predetermined signal is not inputted, after only the discharging operation is performed, the suction purge may also be performed. Alternatively, it may also be designed that before the discharging operation, the test pattern is printed, and after the discharging operation, the predetermined signal is inputted.

Further, in the modification example 1, the user evaluates whether or not the quiescent period is long depending on the printed test pattern, but the present invention is not limited to the above. For example, it may also be designed that the discharge tube 19 is arranged so that a portion thereof can be visually recognized from the outside of the printer 1, and depending on to what extent the ink is accumulated in the above portion of the discharge tube 19, the user evaluates whether or not the quiescent period is long.

Further, in the above-described embodiment, before the initial suction purge to be performed immediately after the power is turned on, the discharging operation and the air discharging purge are performed. However, before the suction purge other than the initial suction purge to be performed immediately after the power is turned on, such as the suction purge to be performed periodically in a state that the power is on, the discharging operation and the air discharging purge may also be performed.

However, as described above, when the power is turned on, it is often the case that the quiescent period is long and a large amount of the thickened ink is accumulated in the discharge tube 19. Therefore, at least before the initial suction purge to be performed immediately after the power is turned on, the discharging operation and the air discharging purge are preferably performed.

Figure 6:
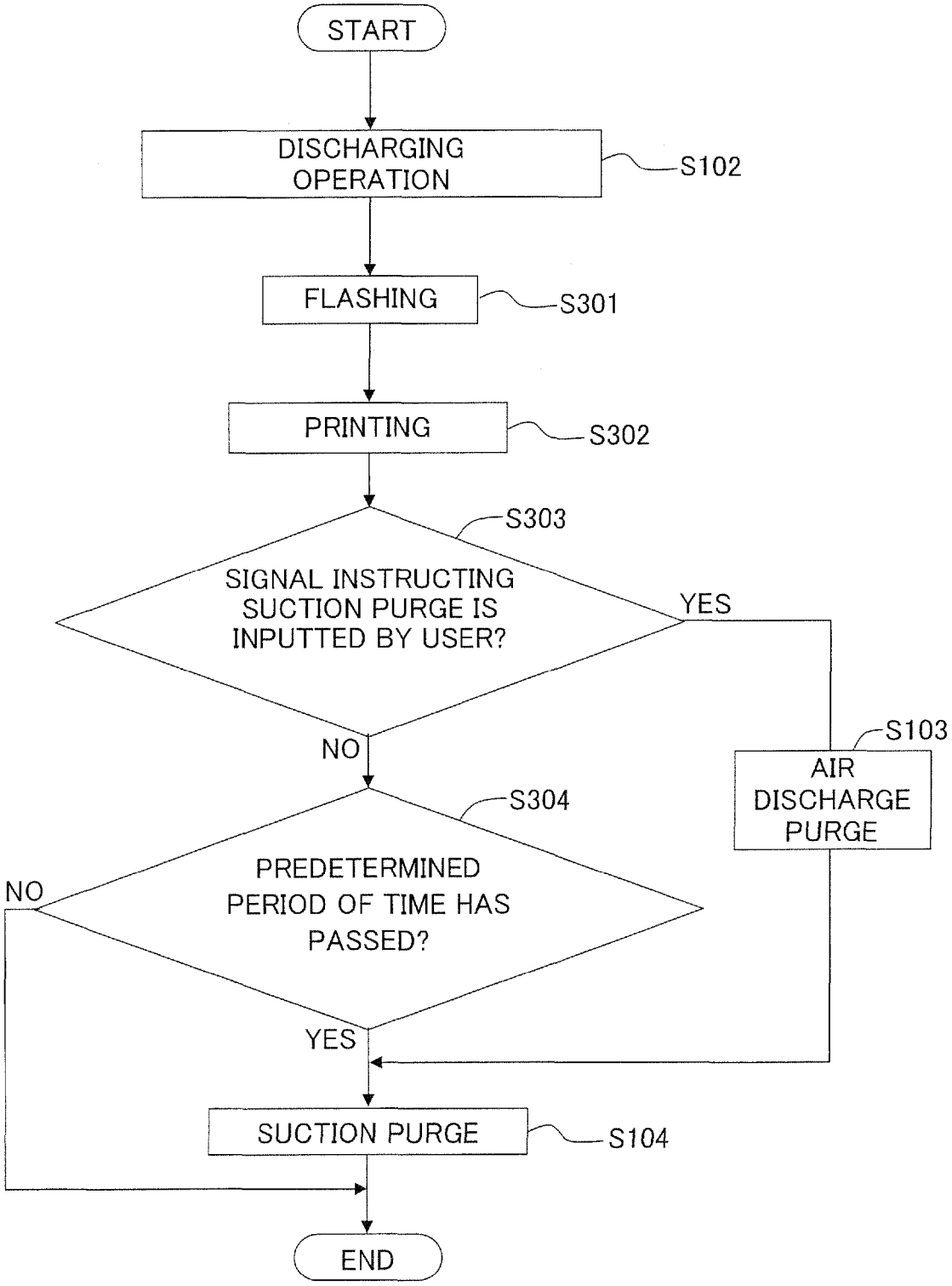
FIG. 6 is a flowchart corresponding to FIG. 4, of a modification example 2.

Further, in the above-described embodiment, the suction purge is always performed immediately after the power is turned on, but the present invention is not limited to the above. In the other modification example (a modification example 2), as shown in FIG. 6, when the power is turned on, similarly to the above, the discharging operation is performed (S102), and thereafter the flashing is performed (S301), and then printing of an image is started immediately (S302).

Then, if the user evaluates that the quiescent period is long and the suction purge is preferably performed based on the image quality of the printed image, the user inputs a signal instructing the printer 1 to perform the suction purge to the maintenance controller 32. Incidentally, in the modification example 2, the above signal instructing the printer 1 to perform the suction purge corresponds to the predetermined signal related to the quiescent period according to the present invention.

Then, the maintenance controller 32 evaluates whether or not the signal instructing the suction purge is inputted by the user (S303), and if the signal instructing the suction purge is inputted (S303: YES), the maintenance controller 32 performs the air discharging purge (S103), and then further performs the suction purge (S104), and ends the maintenance operation. On the other hand, if the signal instructing the suction purge is not inputted (S303: NO), the maintenance controller 32 evaluates whether a predetermined period of time goes by after the latest maintenance operation (S304). If the predetermined period of time goes by (S304: YES), the maintenance controller 32 performs the suction purge (S104), and ends the maintenance operation. If the predetermined period of time does not go by (S304: NO), the maintenance controller 32 ends the maintenance operation without performing the suction purge.

In order to perform printing with high image quality, the suction purge is preferably performed immediately after the power is turned on. However, when high image quality is not required, for example, when a text is printed, even though the suction purge is not performed immediately after the power is turned on and printing is started soon, sufficient image quality is often obtained.

Thus, in the case of the modification example 2, as described above, the suction purge is not performed and an image is soon printed, and only in the case when the signal instructing the printer 1 to perform the suction purge is inputted by the user, the suction purge is performed. Accordingly, when the suction purge is not necessary to be performed, it is possible to continue printing immediately.

On the other hand, when the signal instructing the printer 1 to perform the suction purge is inputted, the discharging operation and the air discharging purge are performed immediately before the input. Accordingly, it is possible to prevent the increase in internal pressure in the discharge tube 19 as described above.

Further, also when the suction purge is not performed, the discharging operation is performed so that the ink, air, and so on in the discharge tube 19 are discharged. Accordingly, it is possible to prevent a large amount of the thickened ink from being accumulated in the discharge tube 19 until the suction purge is next performed.

Further, in the above-described embodiment, the suction speed of the suction pump 8 at which the discharging operation is performed is set to be about equal to that of the suction pump 8 at which the air discharging purge is performed, but the present invention is not limited to the above. As long as the suction speed of the suction pump 8 at which the discharging operation is performed is slower than that of the suction pump 8 at which the suction purge is performed, the suction speed of the suction pump 8 in the discharging operation may also be different from that of the suction pump 8 at which the air discharging purge is performed.

Furthermore, it is not limited that the suction speed of the suction pump 8 at which the discharging operation is performed is slower than that of the suction pump 8 at which the suction purge is performed. The suction speed of the suction pump 8 in the discharging operation may also be about equal to that of the suction pump 8 at which the suction purge is performed.

Further, in the above-described embodiment, after the above-described predetermined signal is inputted from the internal clock 33 and the discharging operation is performed, the air discharging purge is performed. However, the present invention is not limited to the above. For example, after the above-described predetermined signal is inputted from the internal clock 33 and the discharging operation is performed, the discharging operation may also be performed again.

Concretely, it may also be designed that as a reference of the quiescent period, a first predetermined period of time and a second predetermined period of time longer than the first predetermined period of time are set, and when the quiescent period is equal to or longer than the first predetermined period of time and is shorter than the second predetermined period of time, the discharging operation is performed only once. In the case in which the quiescent period is equal to or longer than the second predetermined period of time, the discharging operation is performed twice. When the quiescent period is equal to or longer than the first predetermined period of time and is shorter than the second predetermined period of time and the thickened ink accumulated in the discharge tube 19 is small in amount, the discharging operation is performed only once. Accordingly, it is possible to shorten a time taken for the discharging operation.

On the other hand, in the case in which the quiescent period is equal to or longer than the second predetermined period of time and the thickened ink accumulated in the discharge tube 19 is increased in amount, the discharging operation is performed twice. Accordingly, it is possible to securely discharge the thickened ink in the discharge tube 19.

Incidentally, in the above case, the suction speed of the suction pump 8 and the suction time in the second discharging operation may also be the same as those in the first discharging operation, or may also differ from those in the first discharging operation.

Further, in the above example, when the discharging operation is performed and then the above-described predetermined signal is inputted, the discharging operation is performed again. Namely, as the quiescent period is longer and the more thickened ink in the discharge tube 19 is increased in amount, the discharging operation is performed for a longer period of time. However, the present invention is not limited to the above.

For example, it may also be designed that the above-described predetermined signal is inputted before the discharging operation, and when the above-described predetermined signal is not inputted, the discharging operation is performed only for a predetermined period of time, and when the above-described predetermined signal is inputted, the discharging operation is performed for a longer period of time than the above-described predetermined period of time.

Furthermore, it is not limited that as the quiescent period is longer, the discharging operation is performed for a longer period of time. For example, it may also be designed that the discharging operation is always performed for a fixed period of time before the suction purge irrespective of the length of the quiescent period.

Further, in the above-described embodiment, when the discharging operation is performed, the suction cap 5 is brought into the state of not sealing the spaces facing the nozzles 25, so that the suction pressure of the suction pump 8 does not act so as to suck the inks from the nozzles 25.

However, the present invention is not limited to the above. For example, it may also be set that the switching device 7 is designed to enable the suction pump 8 to communicate not only with the tubes 16*a*, 16*b*, and 17 but also with the outside air, and the switching device 7 makes the suction pump 8 communicate with the outside air, so that the suction pressure of the suction pump 8 does not act so as to suck the inks from the nozzles 25. Then, in this case, since the suction pump 8 and the suction cap 5 are not connected, the suction cap 5 may also be brought into the state of sealing the spaces facing the nozzles 25.

As above, the example where the present invention is applied to the printer provided with what is called the serial-type ink jet head which jets ink droplets while reciprocating in the scanning direction is explained, but the present invention is not limited to the above. It is also possible to apply the present invention to a printer provided with what is called a line head that extends along the entire widthwise length of the recording paper and jets ink droplets without moving, for example.

Furthermore, it is possible to apply the present invention not only to the printer but also to a liquid-droplet jetting apparatus other than a printer, provided with a liquid-droplet jetting head which jets liquid droplets other than ink droplets.

What is claimed is:

1. A liquid-droplet jetting apparatus which jets a liquid droplet of a liquid, comprising:

a liquid-droplet jetting head which has a nozzle for jetting the liquid droplet of the liquid;

a maintenance mechanism which includes:

a suction cap which comes into contact with and separates from the liquid-droplet jetting head and which faces the nozzle;

a suction pump which sucks a fluid in a space defined by the suction cap and the liquid-droplet jetting head in a state that the suction cap comes into contact with the liquid-droplet jetting head; and a discharge tube which is connected to the suction pump and discharges the fluid flowing through the suction pump; and a maintenance controller which controls the maintenance mechanism;

wherein the maintenance controller controls the suction cap to seal the space and controls the suction pump to perform a suction purge in which the liquid is sucked from the nozzle;

wherein the maintenance controller controls the suction pump to perform a discharging operation in which the fluid in the discharge tube is discharged before the suction purge;

wherein the maintenance controller controls the suction pump so that power of the suction pump in the discharging operation is smaller than power of the suction pump in the suction purge; and wherein the maintenance controller controls the maintenance mechanism to increase an operation time for the discharging operation, as a quiescent period during which no liquid droplet is jetted from the liquid-droplet jetting head increases.

2. The liquid-droplet jetting apparatus according to claim 1;

wherein the maintenance controller controls the suction pump so that the liquid is not sucked from the nozzle during the discharging operation.

3. The liquid-droplet jetting apparatus according to claim 1;

wherein under the condition that the maintenance mechanism performs the discharging operation, the maintenance controller controls the suction cap to separate from the liquid-droplet jetting head.

4. The liquid-droplet jetting apparatus according to claim 1;

wherein the maintenance controller controls the suction pump so that a suction speed of the suction pump at which the discharging operation is performed becomes slower than the suction speed of the suction pump at which the suction purge is performed.

5. The liquid-droplet jetting apparatus according to claim 1;

wherein the maintenance controller controls the maintenance mechanism to perform the discharging operation at least immediately before an initial suction purge to be performed immediately after power of the liquid-droplet jetting apparatus is turned on.

6. The liquid-droplet jetting apparatus according to claim 1;

wherein, under the condition that a predetermined signal related to the quiescent period is inputted to the maintenance controller, the maintenance controller controls the maintenance mechanism to perform the discharging operation again after the discharging operation has been performed.

7. The liquid-droplet jetting apparatus according to claim 1, further comprising;

an air discharge channel through which an air in the liquid-droplet jetting head is discharged;

wherein the suction pump is selectively connected to one of the suction cap and the air discharge channel;

wherein the maintenance mechanism further includes a switching mechanism which switches a connection target of the suction pump between the suction cap and the air discharge channel; and wherein, under the condition that a predetermined signal related to the quiescent period is inputted to the maintenance controller, after the discharging operation, the maintenance controller controls the switching mechanism to connect the suction pump to the air discharge channel, and then controls the suction pump to perform an air discharging purge in which an air in the liquid-droplet jetting head is discharged from the air discharge channel.

8. The liquid-droplet jetting apparatus according to claim 1, further comprising:

an internal clock which is driven by a battery;

wherein under the condition that the internal clock, which has stopped driving due to exhaustion of the battery, is recovered after the liquid-droplet jetting apparatus is connected to a power-supply, the predetermined signal is inputted from the internal clock to the maintenance controller.

9. The liquid-droplet jetting apparatus according to claim 1;

wherein the maintenance controller controls the maintenance mechanism to perform the discharging operation only under the condition that the predetermined signal related to the quiescent period is inputted to the maintenance controller.

10. The liquid-droplet jetting apparatus according to claim 6, further comprising:

an input section via which the predetermined signal is inputted to the maintenance controller.

* * * * *